US006843557B2

(12) United States Patent
Matsumoto

(10) Patent No.: US 6,843,557 B2
(45) Date of Patent: Jan. 18, 2005

(54) LIQUID JETTING DEVICE AND LIQUID SUPPLYING METHOD IN USE FOR THE LIQUID JETTING DEVICE

(75) Inventor: Hitoshi Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/314,450

(22) Filed: Dec. 9, 2002

(65) Prior Publication Data

US 2003/0122904 A1 Jul. 3, 2003

(30) Foreign Application Priority Data

Dec. 10, 2001 (JP) ..... 2001-375287

(51) Int. Cl.[7] ..... B41J 2/175
(52) U.S. Cl. ..... 347/85
(58) Field of Search ..... 347/84, 85, 86, 347/87, 92

(56) References Cited

U.S. PATENT DOCUMENTS 6,007,193 A * 12/1999 Kashimura et al. ..... 347/92
6,030,074 A * 2/2000 Barinaga ..... 347/85
6,243,115 B1 * 6/2001 Baker et al. ..... 347/85
6,290,343 B1 * 9/2001 Lewis et al. ..... 347/85

* cited by examiner

*Primary Examiner*—Anh T. N. Vo
(74) *Attorney, Agent, or Firm*—Sughrue Mion, PLLC

(57) ABSTRACT

A liquid jetting device includes a sub tank, a main tank and a compressor. The main tank is communicated with the sub tank, and stores liquid therein. The compressor is communicated with the main tank via an air passage, and applies an air pressure to the main tank such that the liquid in the main tank is supplied to the sub tank. The air passage is communicated with the atmosphere.

19 Claims, 5 Drawing Sheets

LIQUID JETTING DEVICE AND LIQUID SUPPLYING METHOD IN USE FOR THE LIQUID JETTING DEVICE

BACKGROUND OF THE INVENTION

The present invention relates to a liquid jetting device provided with main and sub tanks for supplying liquid to a liquid jetting head, and a liquid supplying method in use for the liquid jetting device.

An ink jet recording device is known as one form of the liquid jetting device. The ink jet recording device includes a liquid jetting head and a paper feeder. Generally, the liquid jetting head is mounted on a carriage, and moved in the width direction of a recording paper as a target, and jets ink droplets as liquid droplets onto the recording paper. The paper feeder relatively moves the recording paper in the direction perpendicular to the moving direction of the liquid jetting head.

In the ink jet recording device, something is printed on the recording paper in a manner that the liquid jetting head ejects, ink droplets on the recording paper in accordance with print data as jetting data.

The ink jet recording device is capable of a full color printing as well as the text printing by use of black ink. To the full color printing, liquid jetting heads capable of jetting or ejecting color inks of, for example, black, yellow, cyan and magenta are mounted on the carriage, and ink ejection ratios of those inks are varied.

Ink cartridges as liquid cartridges for supplying the inks to the liquid jetting heads are disposed within the ink jet recording device.

In a normal ink jet recording device, ink cartridges containing the inks are mounted on the carriage, and moved together with the carriage.

In the ink jet recording device, which are supplied for office or business use, ink cartridges of large capacity are located outside the carriage for dealing with the printing of a relatively large volume of data.

An ink jet recording device of the type in which an ink cartridge holder provided in the apparatus main body is loaded with a main tank as an ink cartridge, is also known. Sub tanks are provided on the cartridge on which the liquid jetting heads are mounted. Ink is supplied from each main tank to a related sub tank through an ink supplying tube (ink passage) as a liquid supplying tube. Further, the ink is supplied from the sub tank to a related liquid jetting head.

To improve the throughput, such a recording device is required to have such a function that ink is successively supplied from each main tank to the related sub tank while the printing is executed, and the ink is stably supplied from the sub tank to the related liquid jetting head.

To satisfy such a requirement, preferably employed, is that an ink pack as a liquid pack in the main tank is pressurized by air to cause an ink stream flowing from the main tank to the sub tank, thereby enabling the supplying ink to the sub tank. In this case, it is important that an excessive pressure is not applied to the ink pack of the main tank.

To avoid the excessive pressure application, an ink jet recording device with a liquid supplying system as shown in FIG. 5 has been used. In the device, a pressure of ink is adjusted when it is supplied from the main tank to the sub tank.

The ink supplying system of the ink jet recording device will be described with reference to FIG. 5.

In the figure, reference numeral 21 designates an air pressure pump. Air that is pressurized by the air pressure pump 21 is supplied to a pressure regulating valve 22, and is supplied to main tanks 9 (only one main tank is illustrated) by way of a pressure detector 23.

The pressure regulating valve 22 operates such that when air that is pressurized by the air pressure pump 21 reaches a predetermined pressure or higher, the valve is opened to regulate the pressure of the air applied to the main tanks 9 to be within a predetermined range of pressure. The pressure detector 23 detects a pressure of the air pressurized by the air pressure pump 21, and controls the driving of the air pressure pump 21.

With such an arrangement, each main tanks 9 (ink pack 24) receives the pressure of the pressurized air, and creates an ink stream from the main tank 9 to the related sub tank under the predetermined pneumatic pressure.

The ink pressurized by each main tank 9 is supplied to a related sub tank by a related ink supplying valve 26 and a related ink supplying tube 10.

In the liquid jetting device thus arranged, the pneumatic pressure that is supplied from the air pressure pump 21 to the main tank 9 is regulated, by use of the pressure regulating valve 22 and the pressure detector 23, in the following way.

When the pressure detector 23 detects that a pressure of the air pressurized by the air pressure pump 21 reaches a predetermined pressure, the air pressure pump 21 is stopped. When the pressure detector 23 detects that a pressure of the air pressurized by the air pressure pump 21 decreases to be below the predetermined pressure, the air pressure pump 21 is driven.

The liquid jetting device, which employs such a pneumatic pressure regulating arrangement, has disadvantages of increase of the number of required parts, complicated control for the pressure regulation, and increase of cost to manufacture.

Accordingly, an object of the present invention is to provide a liquid jetting device which is capable of reducing the number of required parts, eliminating the complicated control for the pressure regulation as needed by the related device, and reducing the cost to manufacture, and a liquid supplying method in use for the liquid jetting device.

SUMMARY OF THE INVENTION

It is therefore an object of the present invention to provide a liquid jetting device and a liquid supplying method in use for the liquid jetting device being capable of reducing the number of required parts, eliminating the complicated control for the pressure regulation as needed by the related device, and reducing the cost to manufacture, and a liquid supplying method in use for the liquid jetting device.

In order to achieve the above object, according to the present invention, there is provided a liquid jetting device comprising:

a sub tank;

a main tank, communicated with the sub tank, and storing liquid therein; and a compressor, communicated with the main tank via an air passage, and applying an air pressure to the main tank such that the liquid in the main tank is supplied to the sub tank, wherein the air passage is communicated with the atmosphere.

In the above configuration, with such a mechanical arrangement, the air pressure is applied from the compressor to the air passage, and is received by the main tank. In turn, the liquid is supplied from the main tank to the sub tank. At this time, part of the air pressure that is applied from air pressure pump to the main tank is let to flow from a hole of the air passage to the atmosphere, whereby the air pressure is regulated.

In this case, an amount of the air pressure which is based on the amount of air pressure applied form the compressor into the air passage, is let to discharged into the, air.

Therefore, the necessity of using the pressure regulating valve and the pressure detector, which are needed for the regulation of the air pressure applied from the compressor to the main tank in the related device, is eliminated.

Accordingly, the invention is capable of reducing the number of required parts, eliminating the complicated control for the pressure regulation as needed by the related device, and reducing the cost to manufacture.

Preferably, the main tank includes:

a liquid pack, comprised of flexible material, and storing the liquid therein; and a container containing the liquid pack, and a pressure chamber, into which the air pressure may be applied, is formed between the container and the liquid pack.

In the above configuration, liquid is supplied from the main tank to the sub tank in a manner that an air pressure is applied from the compressor to the pressure chamber within the container to pressurize the liquid pack.

Preferably, the air passage has a hole on a wall thereof so as to communicate with the atmosphere.

Here, it is preferable that the hole is a slit shaped hole.

In the above configuration, when the air pressure is applied from the compressor to the main tank, part of the air pressure is discharged to the air via the hole of the air passage.

Preferably, the liquid jetting device further comprising an air release passage, connected to the air passage so as to communicate with the atmosphere, and the air release passage has a flow resistance larger than that of the air passage.

Here it is preferable that the air release passage is provided as a pipe member.

Here it is preferable that the pipe member is formed with a flexible tube.

Here it is preferable that the pipe member is comprised of metal.

Here it is preferable that the air release passage includes a base member having a groove, and a sealing member sealing the groove of the base member.

Here it is preferable that the base member is formed with a plastic plate, and the sealing member is formed with a plastic film.

Here it is preferable that the groove extends in a meandering shape.

In the above configurations, part of the air pressure that is applied from the compressor into the air passage flows out into the air via the hole and the groove in accordance with the amount of applied air pressure. As a result, the pressure regulation is effectively carried out.

Therefore, the air pressure flowing from the air passage into the hole and the air release passage is regulated, so that the air pressure applied from the compressor to the air passage is effectively regulated.

According to the present invention, there is also provided a liquid supplying method in use for a liquid jetting device including a sub tank, a main tank communicated with the sub tank and storing liquid therein, and a compressor communicated with the main tank via an air passage, the liquid supplying method comprising the steps of:

applying an air pressure to the air passage for supplying the liquid in the main tank to the sub tank; and releasing a part of the air pressure applied to the air passage into atmosphere.

In the liquid supplying method, the pneumatic pressure is applied from the compressor to the air passage, and is received by the main tank. In turn, the liquid is supplied from the main tank to the sub tank. At this time, part of the air pressure that is applied from compressor to the main tank is let to flow from the hole of the air passage to the air, whereby the air pressure is regulated.

Therefore, the necessity of using the pressure regulating valve and the pressure detector, which are needed for the regulation of the air pressure supplied from the compressor to the main tank in the related device, is eliminated.

Accordingly, the invention is capable of reducing the number of required parts, eliminating the complicated control for the pressure regulation as needed by the related device, and reducing the cost to manufacture.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An ink jet recording device, which is one form of a liquid jetting device constructed according to the present invention, and a liquid supplying method in use for the liquid jetting device.

Figure 1:
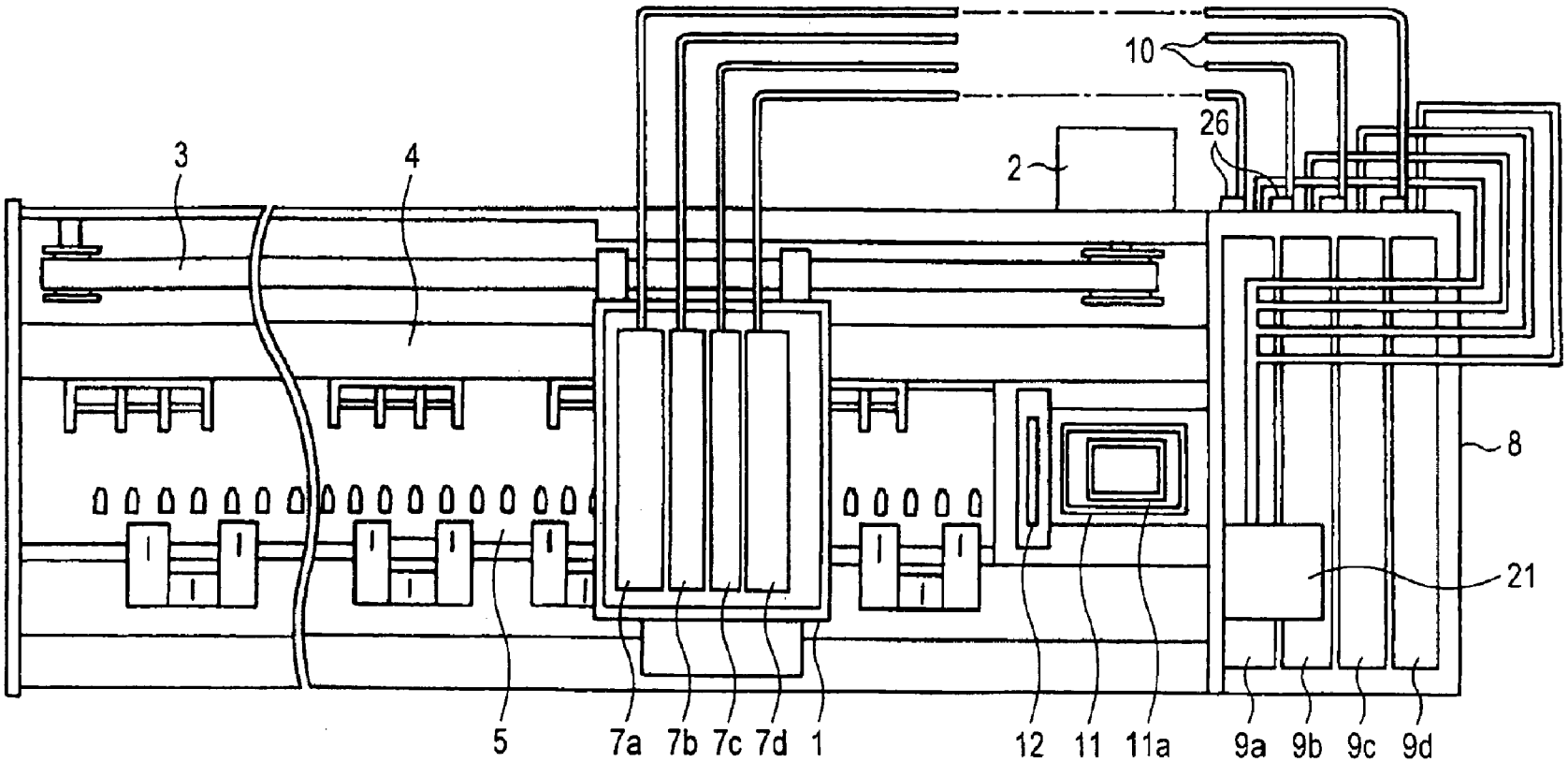
FIG. 1 is a plan view showing an inkjet recording apparatus according to a first embodiment of the present invention.

First, the ink jet recording device will be described with reference to FIG. 1. FIG. 1 shows, in plan view, a basic construction of the ink jet recording device.

A carriage 1 is reciprocatively moved with the aid of a timing belt 3, which is driven by a carriage motor 2, in the longitudinal direction of a paper feeding member 5, i.e., the width direction of a recording paper, while being guided by a guide member 4. An ink jetting head 6 (see FIG. 2) of the ink jet type, not illustrated in FIG. 1, is mounted on a face of the carriage 1, which is confronted with the paper feeding member 5.

Sub tanks 7*a* to 7*d* for supplying ink to the ink jetting head 6 are mounted on the carriage 1.

Four sub tanks 7*a* to 7*d* are provided which temporarily store color inks of black, yellow, magenta and cyan Those sub tanks 7*a* to 7*d* receive those color inks from main tanks 9*a* to 9*d* as ink cartridges, which are loaded to a cartridge holder 8 contained in the apparatus main body, through ink supplying tubes 10 made of flexible material.

The main tanks 9*a* to 9*d* as ink cartridges receive a pneumatic pressure from an air pressure pump 21, and responsively produce ink streams flowing from the main tanks 9*a* to 9*d* to the sub tanks 7*a* to 7*d* under a predetermined pressure.

A capping member 11 is disposed in a non-printing area (home position) on the moving path of the carriage 1. A capping portion 11*a,* made of flexible material, e.g., rubber, which is capable of sealing the nozzle forming face of the ink jetting head 6, is provided on the upper face of the capping member 11.

When the carriage 1 moves to the home position, it seals the nozzle forming face of the liquid jetting head with the capping portion 11*a*.

The capping portion 11*a* seals the nozzle forming face of the ink jetting head 6 during a pause period of the recording device so as to prevent the nozzle orifices from being dried. One end of a suction pump (tube pump) (not shown) is connected to the capping portion 11*a*, and the pump applies a negative pressure to the ink jetting head 6 to suck the ink from the ink jetting head 6 and discharge it outside. That is, the pump executes a cleaning operation.

A wiping member 12, made of elastic material, e.g., rubber, is disposed adjacent to the printing area o the capping member 11. The wiping member 12 wipes the nozzle forming face of the ink jetting head 6, if necessary.

Figure 2:
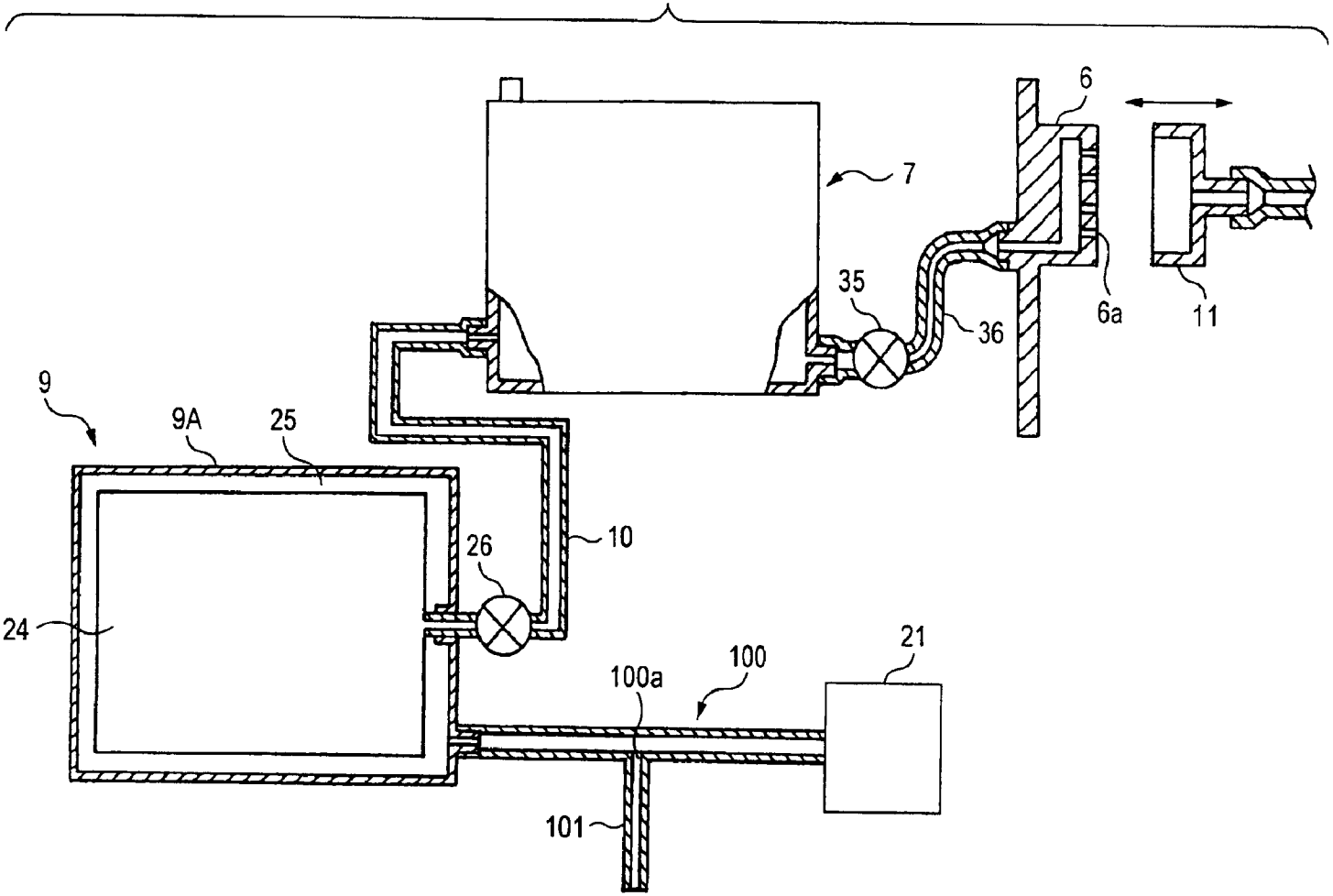
FIG. 2 is a diagram showing an ink supplying system ranging from a main tank to an ink jetting head in the ink jet recording apparatus shown in FIG. 1.
Figure 5:
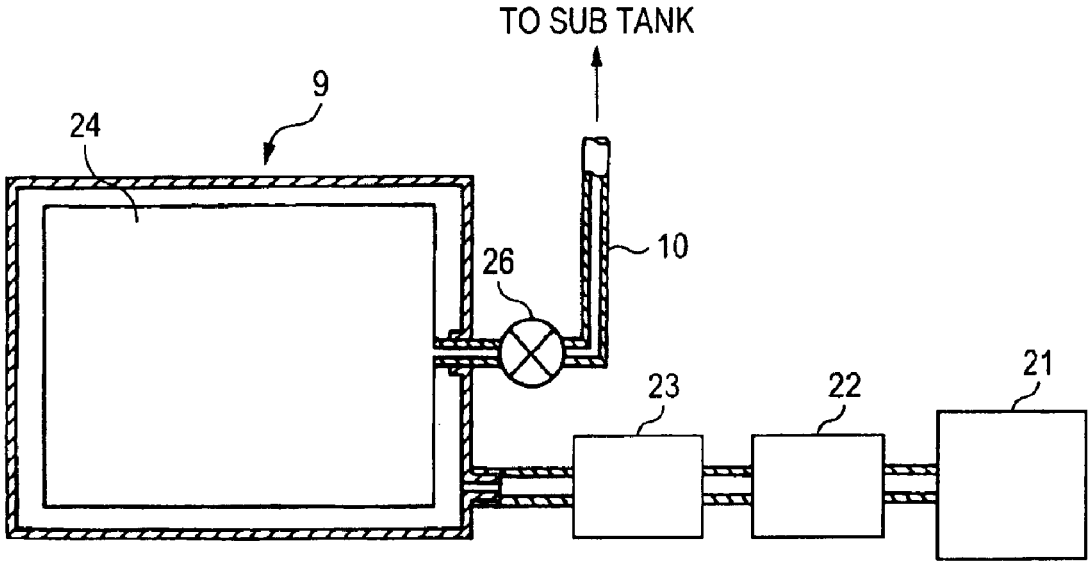
FIG. 5 is a diagram showing an ink supplying system ranging from a main tank to a sub tank in a related ink jet recording apparatus.

FIG. 2 is a diagram showing the ink supplying system incorporated into the ink jet recording apparatus shown in FIG. 1. The ink supplying system will be described together with FIG. 1 in which like reference numerals are used for designating like or equivalent portions. In FIG. 2, like or equivalent portions are designated by like reference numerals in FIG. 5.

As shown in FIG. 2, an ink pack 24, made of flexible material, for hermitically containing ink therein is provided within an outer case (sealed container) 9A of the main tank 9. A pressure chamber 25 is formed between the outer case 9A and the ink pack 24. The pressure chamber 25 receives a pressurized air from the air pressure pump 21 through an air passage 100.

The air passage 100 consists of a metal pipe, and is connected to the air pressure pump 21 and the main tank 9. A thin hole 100*a* as a through hole is formed in a middle of the air passage 100. A vent pipe 101 as an air release passage is integrally formed at the peripheral edge of the outside opening of the thin hole 100*a*. The thin hole 100*a* is opened to release the air to atmosphere via the vent pipe 101.

The thin hole 100*a* is a circular opening having a flow resistance larger than that of the air passage 100. In other words, a caliber of the thin hole 100*a* is smaller than that of the air passage 100. A caliber of the vent pipe 101 is selected to be equal to that of the thin hole 100*a*. As a result, a pneumatic pressure which is supplied from the air pressure pump 21 to the pressure chamber 25 of the main tank 9 is regulate in such a way that it partly flows from the thin hole 100*a* of the air passage 100 to the vent pipe 101 and to atmosphere.

In the above configuration, the ink packs 24 contained in the main tanks 9*a* to 9*d* (generally designated by numeral 9 in FIG. 2) receive a fixed pressure by the pressurized air. As a result, ink streams are generated flowing from the main tanks 9*a* to 9*d* to the sub tanks 7*a* to 7*d* under a predetermined pressure.

The ink pressurized in each of the main tanks 9*a* to 9*d* is supplied to the corresponding sub tank of those sub tanks 7*a* to 7*d* (generally designated by numeral 7 in FIG. 2) mounted on the carriage 1, via the corresponding ink supplying valve 26 and the corresponding ink supplying tube 10.

The ink supplying valve 26 is driven to open and close in accordance with an ink level in the sub-tank 7, which is detected by an ink-level detector (not shown). Through the action of the ink supplying valve, ink is intermittently supplied from the main tank 9 to the sub-tank 7, so that the ink is stored in an ink level within a predetermined range of level, in the sub-tank 7.

Ink is supplied from the sub-tank 7 to the ink jetting head 6 via the an open/closing valve 35 and an ink supply actuator 36. Ink droplets are elected from nozzle orifices 6*a* formed in the nozzle forming face of the ink jetting head 6 in accordance with print data supplied to actuators (not shown) of the ink jetting head 6.

An ink supplying method in use for the ink jet recording device which the present embodiment, will be described with reference to FIG. 2.

The ink supplying method is carried out by supplying a pneumatic pressure from the air pressure pump 21 to the air passage 100.

In this case, the pneumatic pressure is supplied from the air pressure pump 21 to the air passage 100, and is received by the main tank 9. In turn, ink is supplied from the main tank 9 to the sub-tank 7 via the ink supplying valve 26 and the ink supplying tubes 10. At this time, part of the air pressure is let to flow from the thin hole 100*a* of the air passage 100 to the vent pipe 101 and further to atmosphere, whereby the air pressure is regulated.

The functions of the thin hole 100*a* and the vent pipe 101 in the present embodiment will be described below.

The thin hole 100*a* and the vent pipe 101 exhibit their functions when the pressurized air is supplied from the air pressure pump 21 to the air passage 100.

With the supply of the air pressure (amount of air) from the air pressure pump 21 to the air passage 100, part of the air pressure is led into the thin hole 100*a* and the vent pipe 101. At this time, part of the air pressure that is supplied from the air pressure pump 21 to the air passage 100 is let to flow out to atmosphere via the thin hole 100*a* of the air passage 100, whereby the air pressure is regulated.

In this case, the outflow of the air pressure from the thin hole 100*a* into the air is based on the amount of air pressure supplied form the air pressure pump 21 into the air passage 100. In a small amount of air pressure supplied from the air pressure pump 21, a relatively small amount of supplied air pressure flows into the air from the thin hole 100*a* via the vent pipe 101. When the amount of air pressure supplied from the air pressure pump 21 is large, a relatively large amount of supplied air pressure flows into the air from the thin hole 100*a* via the vent pipe 101.

Therefore, the necessity of using the pressure regulating valve and the pressure detector, which are needed for the regulation of the air pressure supplied from the air pressure pump 21 to the main tank 9 in the related device, is eliminated.

Accordingly, the present embodiment is capable of reducing the number of required parts, eliminating the complicated control for the pressure regulation as needed by the related device, and reducing the cost to manufacture.

Figure 3:
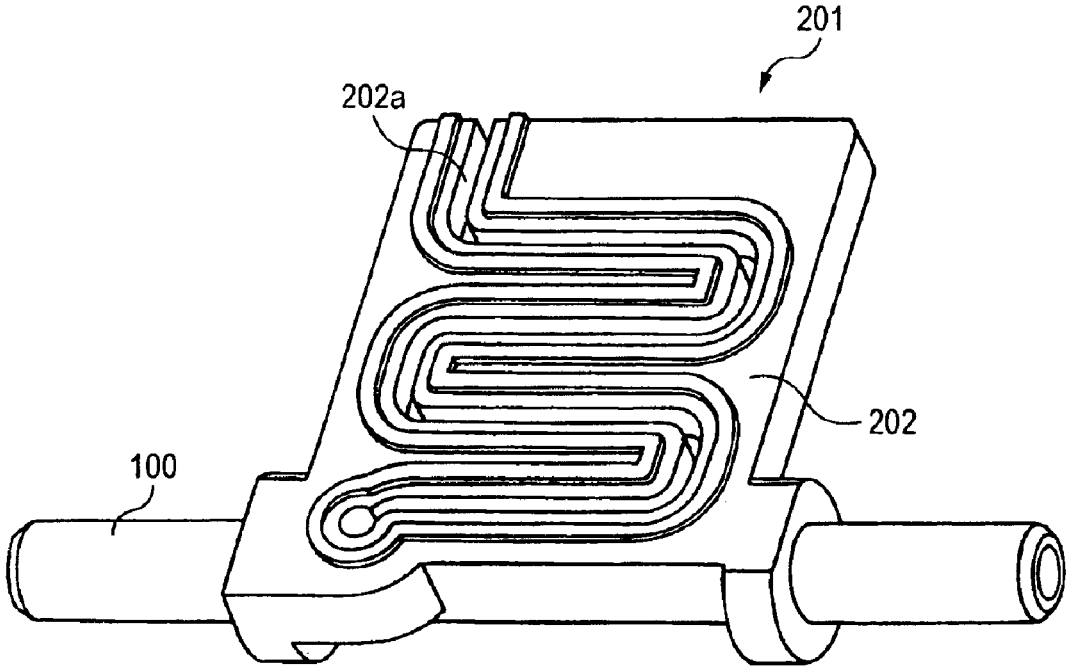
FIG. 3 is a perspective view showing a major portion of an ink jet recording apparatus according to a second embodiment of the present invention.

In the embodiment mentioned above, the air release passage corresponds to the vent pipe 101. It may be as shown in FIGS. 3 and 4A to 4C. FIG. 3 is a perspective view showing a major portion of an ink jet recording apparatus according to a second embodiment of the present invention.

Figure 4A:
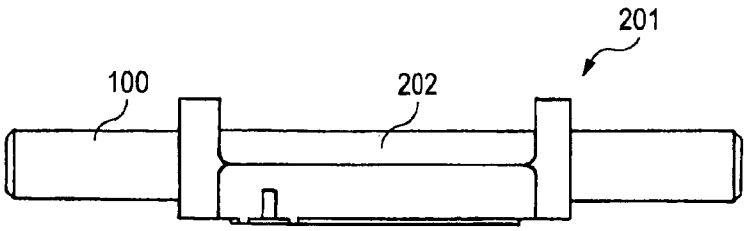
FIGS. 4A to 4C are front, plan and side views showing a major portion of the ink jet recording apparatus according to the second embodiment of the invention.
Figure 4B:
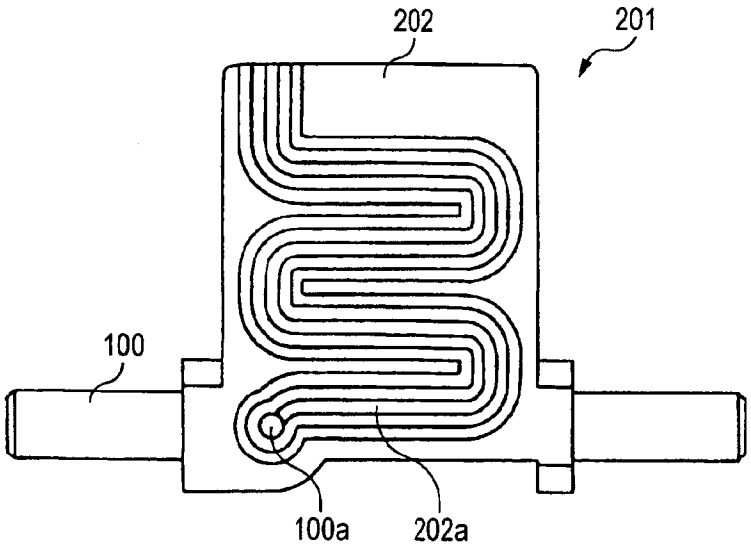
Figure 4C:
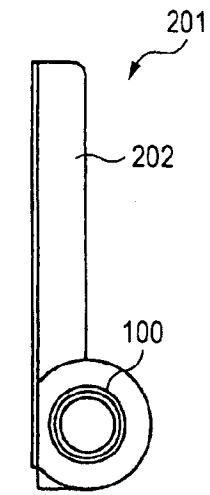

FIGS. 4A to 4C are front, plan and side views showing a major portion of the ink jet recording apparatus according to the second embodiment of the invention.

An air release passage 201 shown in FIGS. 3 and 4A to 4C includes a base 202 and a sealing member (not shown), and is connected to the air passage 100.

The base 202 is formed with a plastic plate. A groove 202*a,* shaped like U in cross section, which communicates with the thin hole 100*a* is formed on the base 202. The groove 202*a* is shaped in a meandering arrangement when viewed from top, and has a flow resistance, which is larger than that of the air passage 100. Part of the air pressure that is supplied from the air pressure pump 21 into the air passage 100 flows out into the atmosphere via the thin hole 100*a* and the groove 202*a* in accordance with the amount of supplied air pressure. As a result, the pressure regulation is more effectively carried out.

The sealing member (not shown) is formed with a plastic film for sealing the groove 202*a*.

In this embodiment mentioned above, the air passage 100 and the vent pipe 101 are formed with metal pipes. If required, flexible tubes or the like may be used instead. In this embodiment, the thin hole 100*a* is the opened part circular in cross section. However, the configuration of it is not limited to such, in particular. For example, it may be a slit instead.

In the embodiments mentioned above, the ink jet recording device (printing device including facsimile, copier and the like) for ejecting ink is used for the liquid jetting device. The liquid jetting device may eject another kind of liquid, as a matter of course. Examples of such devices are a liquid jetting device for jetting liquid, e.g., electrode material or colorant, used in manufacturing LCD devices, EL display devices, FET (field emission display) devices, a test sample jet device as an accurate pipette.

What is claimed is:

1. A liquid jetting device comprising:

a sub tank;

a main tank in communication with the sub tank, and operable to store liquid therein; and a compressor in communication with the main tank via an air passage, and operable to apply air pressure to the main tank such that the liquid in the main tank is supplied to the sub tank, wherein the air passage is in constant communication with the atmosphere.

2. The liquid jetting device as set forth in claim 1, wherein the main tank comprises:

a liquid pack made of flexible material, and operable to store the liquid therein;

a container operable to contain the liquid pack; and a pressure chamber formed between the container and the liquid pack and operable to accommodate the air pressure applied by the compressor.

3. The liquid jetting device as set forth in claim 1, wherein the air passage has a hole on a wall thereof so as to communicate with the atmosphere.

4. The liquid jetting device as set forth in claim 3, wherein the hole is a slit shaped hole.

5. The liquid jetting device as set forth in claim 1, further comprising an air release passage, connected to the air passage so as to communicate with the atmosphere, wherein the air release passage has a flow resistance larger than that of the air passage.

6. The liquid jetting device as set forth in claim 5, wherein the air release passage is provided as a pipe member.

7. The liquid jetting device as set forth in claim 6, wherein the pipe member is formed with a flexible tube.

8. The liquid jetting device as set forth in claim 6, wherein the pipe member is comprised of metal.

9. The liquid jetting device as set forth in claim 5, wherein the air release passage includes a base member having a groove, and a sealing member sealing the groove of the base member.

10. The liquid jetting device as set forth in claim 9, wherein the base member is formed with a plastic plate, and the sealing member is formed with a plastic film.

11. The liquid jetting device as set forth in claim 9, wherein the groove extends in a meandering shape.

12. A liquid supplying method for a liquid jetting device including a sub tank, a main tank communicated with the sub tank and storing liquid therein, and a compressor communicated with the main tank via an air passage, the liquid supplying method comprising:

applying air pressure to the air passage for supplying the liquid in the main tank to the sub tank; and releasing a part of the air pressure applied to the air passage into atmosphere, wherein the air passage is in constant communication with the atmosphere.

13. A recording device operable to jet liquid comprising:

a jet head operable to jet the liquid onto a recording medium;

a sub tank operable to store the liquid and supply the liquid stored therein to said jet head through a liquid actuator;

a main tank operable to store more of the liquid than said sub tank and supply the liquid stored therein to said sub tank through a supply line; and a compressor operably connected to said main tank via an air passage comprising a hole in a wall therein that is always open to the atmosphere, wherein said compressor is operable to supply air into the air passage and increase a pressure applied to the liquid within said sub tank.

14. The recording device as claimed in claim 13, wherein the hole in the wall of the air passage is circular.

15. The recording device as claimed in claim 13, wherein the hole in the wall of the air passage is has a smaller cross section than a cross section of the air passage.

16. The recording device as claimed in claim 15, further comprising a vent pipe a first end of which is connected to the air passage, said vent pipe being operable to vent air from the hole in the air passage to the atmosphere through a second end thereof.

17. The recording device as claimed in claim 16, wherein a cross section of a hollow portion of the vent pipe connecting the first and second ends thereof is identical to a cross section of the hole in the air passage.

18. The recording device as claimed in claim 13, wherein the hole in the wall of the air passage is smaller than a cross section of a portion of the air passage through which air is supplied to said main tank.

19. The recording device as claimed in claim 13, further comprising a valve connected to the liquid actuator and operable to either close or open a path through which the liquid is supplied from said sub tank to the liquid actuator.

* * * * *